United States Patent [19]

Jennie

[11] Patent Number: 4,516,466

[45] Date of Patent: May 14, 1985

[54] MECHANISM PROVIDING POSITIVE SAFETY WITH BOLT LOCKED

[75] Inventor: Fred Jennie, Santa Ana, Calif.

[73] Assignee: Weatherby, Inc., South Gate, Calif.

[21] Appl. No.: 458,559

[22] Filed: Jan. 17, 1983

Related U.S. Application Data

[63] Continuation-in-part of Ser. No. 261,527, May 7, 1981, abandoned.

[51] Int. Cl.[3] ..... F41C 5/00; F41D 3/00

[52] U.S. Cl. ..... 89/145; 89/168; 89/176; 89/190

[58] Field of Search ..... 89/145, 150, 154, 141, 89/168, 176, 190

[56] References Cited

U.S. PATENT DOCUMENTS

| | | | |
|---|---|---|---|
| 768,665 | 8/1904 | Johnson | 89/145 |
| 1,115,979 | 11/1914 | Sillix | 42/75 C |
| 1,572,450 | 2/1926 | Swebilius | 42/75 C |
| 2,418,946 | 4/1947 | Loomis | 89/168 |
| 2,499,090 | 2/1950 | Browning | 89/190 |
| 3,577,827 | 5/1971 | Billett | 89/145 |
| 3,866,344 | 2/1975 | Kawamura | 89/190 |
| 4,017,996 | 4/1977 | Liedke | 42/69 B |
| 4,185,537 | 1/1980 | Hayashi | 89/145 |

*Primary Examiner*—Charles T. Jordan
*Assistant Examiner*—Ted L. Parr
*Attorney, Agent, or Firm*—Evanns & Walsh

[57] ABSTRACT

A gun mechanism for guns embodying safety mechanism. The mechansim includes a trigger, a sear, and a hammer in operative relationship. A disconnector member is carried by the trigger and is operative to disconnect the sear from the hammer for firing. An extending member extends from the bolt carrier to a position over the trigger mechanism. A link member is positioned between the extending member and the disconnector member and is operative to hold the disconnector member in an inactive position, that is, a safe position at all times unless the said extending member is in a fully forward closed and locked position of the bolt. A bolt carrier has a limited sliding relationship with the bolt which includes a bolt locking member. The carrier undergoes an initial movement before the bolt moves which operates the link member to the safe position, after which the bolt is unlocked for movement. Positive safety is provided in that the disconnector member is held inactive unless the bolt is fully closed and locked.

8 Claims, 9 Drawing Figures

MECHANISM PROVIDING POSITIVE SAFETY WITH BOLT LOCKED

BACKGROUND OF THE INVENTION

This application is a continuation-in-part of Ser. No. 261,527, filed 05/07/81, abandoned.

1. Field of the Invention

The field of the invention is that of trigger mechanisms which may be adapted for use in shotguns. The invention deals more particularly with a positive safety mechanism which blocks and prevents release of the sear for causing the hammer to fire in response to the trigger except when the bolt of the gun is in the fully forward closed position.

2. Description of the Prior Art

In the prior art various types of safety mechanisms are shown in connection with guns and trigger mechanisms.

With respect to prior art known to the applicant, reference is made to U.S. Pat. Nos. 3,577,827; 4,017,996; and 4,185,537.

What has been lacking in the prior art is a mechanism whereby positive disengagement as between the trigger and the sear would be effected whenever the bolt is in other than closed position. Further, there has not been means in the prior art for positively effecting this purpose independently of trigger movement.

Despite various types of safety devices that have been designed for guns, accidents do happen with guns, including shotguns. There have been known in the prior art safety devices in the form of disconnectors operative as between the bolt and the trigger assembly for purposes of rendering the trigger assembly inactive if the bolt is not in position ready for firing. Such safety devices as have been known have not embodied the particular characteristics of the one described in detail herein.

SUMMARY OF THE INVENTION

The mechanism of the invention is described briefly in the abstract. There is, of course, a hammer which is pivotally mounted and which is driven by a hammer spring in a direction to strike the firing pin. The hammer cooperates with a sear which is pivoted and which is able to hold the hammer and to disengage it for firing. The sear is activated by a connector member or member (which is called a disconnector member herein) which can cause the sear to disengage from the hammer for firing. (This part in some technical descriptions is called a connector member).

In the herein invention, the disconnector member is in the form of a bell crank lever having pivotal attachment to the trigger member. The trigger member is a member mounted on a pivot at the forward part so that it can be pulled backward for firing. The disconnector member has a pivotal connection to the trigger and is also connected to it by pin and slot connection to provide for only limited relative movement as between the disconnector and the trigger. The trigger carries a biasing spring which acts on the disconnector member. The disconnector member can be moved relative to the trigger against the force of the spring.

The improvement of the invention resides in part in a safety disconnector link. The gun includes a carrier extension member which extends rearwardly from the bolt of the gun to a position over the trigger assembly and which engages a plunger biased by a spring. The safety link disconnector is in a position between the disconnector member which is actuatable by the trigger and the extension member. The safety link member has a part juxtaposed against and in direct contact with the disconnector member. It has an end or toe member which can engage in a notch in an end part of the extension member. The end of the safety link member engages in the notch only when the carrier extension is in the fully forward position with the bolt in that position and locked. It is only in that position that the end or toe on the safety link engages in the notch in the carrier extension and because of the engagement between the safety link and the disconnector link, it is only in that position that the sear can be released by the trigger for firing. Positive safety in this respect is thereby insured.

When the toe end of the safety link is in the notch of the carrier extension, the safety link then does not act on the disconnector to prevent it from being actuated to disengage the sear by the trigger. Otherwise the disconnector is held from such movement.

The carrier extension is attached to the bolt carrier which cooperates with the bolt and bolt locking member. The initial movement of the bolt carrier operates the safety link to disconnect the trigger from the sear. The disconnect remains in effect until the bolt returns to locked position.

In the light of the foregoing, it can be seen that a positive safety mechanism is provided whereby the trigger can be pulled but the gun cannot be fired unless the bolt is in completely closed and locked position.

In a preferred construction the trigger assembly is a unitary assembly that includes the trigger itself and the trigger guard, the assembly fitting into an opening in the lower part of the receiver of the gun. Further improvement is provided in that the trigger assembly is provided with a cover plate that fits over the trigger assembly or trigger unit. The cover plate has a cutout at one side, and it has a slot in it which serves as a guide for the movement of the hammer forwardly and against the firing pin. The carrier extension member may be in the form of a bifurcated member, that is, a member having legs with a slot in between which can accommodate the hammer.

In the light of the foregoing, the primary object of the invention is to realize a positive safety capability as identified in the foregoing whereby the gun cannot be fired unless the bolt is in completely closed and locked position.

A further object is to realize the above safety feature by way of a safety link member which is positioned to provide engagement between the carrier extension from the bolt and the disconnector which engages the sear, the said safety link being constructed so as to positively engage the disconnector so as to prevent it from operating the sear except when the carrier extension is in the fully closed position of the bolt.

A further object is to provide assurance that in all positions of the bolt except the locked position the safety link is disconnects the trigger from the sear.

A further object is to realize the safety purpose as set forth in the foregoing wherein the safety link is a pivoted member juxtaposed against the disconnector so as to positively actuate it to disconnect position except when the bolt is fully closed.

Further objects and additional advantages of the invention will become apparent from the following description and annexed drawings.

DESCRIPTION OF THE PREFERRED EMBODIMENT AND BEST MODE OF PRACTICE OF THE INVENTION

Figures 1, 2, 3:
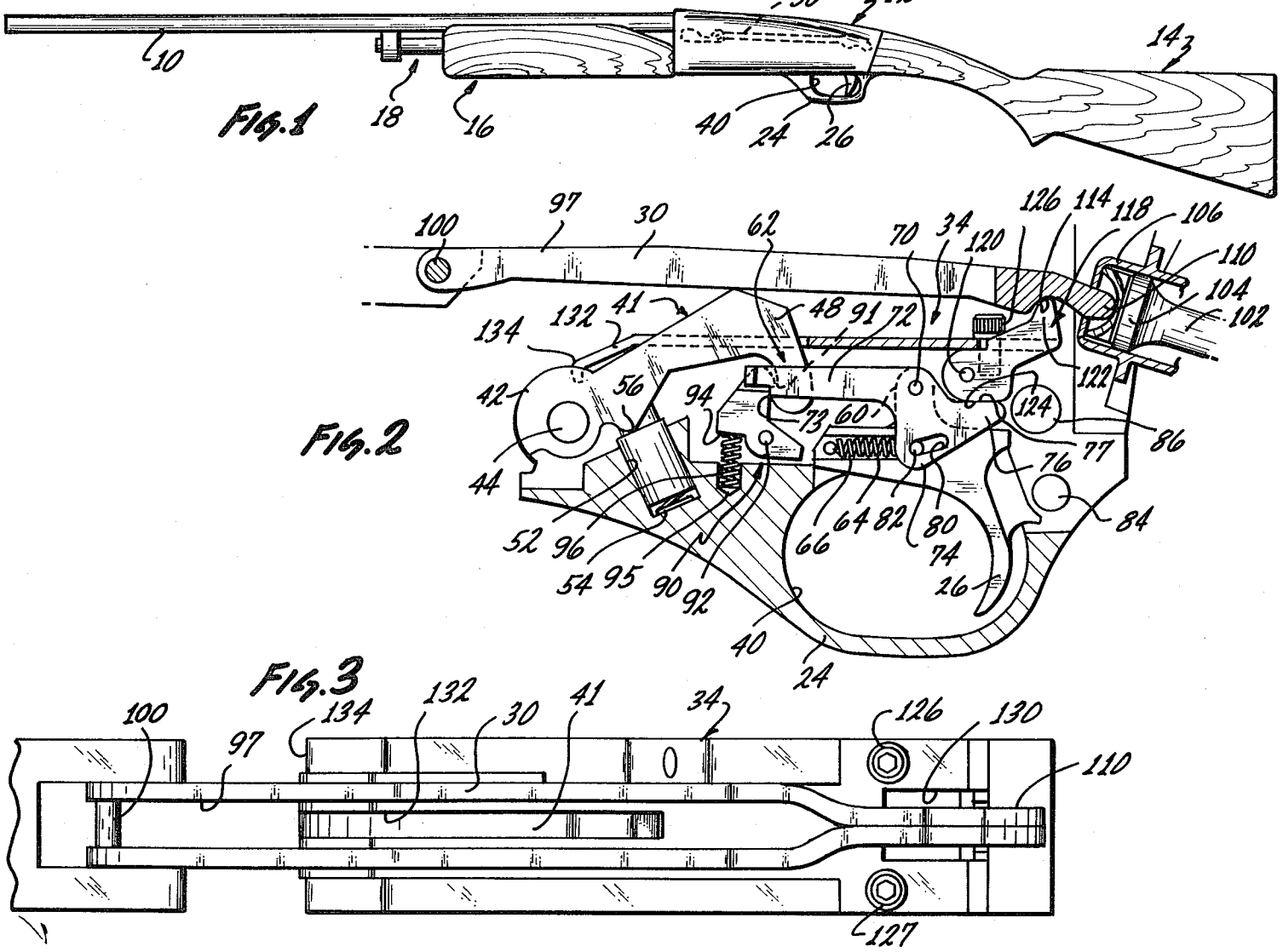
FIG. 1 is a pictorial view of a gun in which the construction of the invention may be embodied.
FIG. 2 is an elevational view partly in a section of a preferred form of the invention.
FIG. 3 is a view of a cover plate with hammer guide which fits over the trigger assembly.

FIG. 1 of the drawings shows a shotgun in which the invention may be embodied. The gun as shown has a barrel 10, a receiver 12, and a stock 14. Numeral 16 designates the forearm which fits over the magazine tube 18. The trigger guard is designated at 24 and the trigger at 26 in FIG. 1. The carrier extension member attached to the bolt is shown in outline in FIG. 1 and is designated at 30 in FIG. 2.

FIG. 2 is an elevational view of the trigger assembly with the hammer in a cocked position ready for firing. See FIGS. 6 and 7. The parts of the trigger assembly are assembled as a unit and a cover plate is provided as designated at 34, which will be referred to again presently. See FIG. 3. The trigger guard 24 has a shape as shown in FIG. 2 including an opening 40 so as to form a guard for the trigger 26. The hammer is designated at 41 having a shape as shown. The hammer has a rounded part 42 pivotally mounted on a pivot member 44. It has a hook shape as shown at 48 on the inside of which is a shoulder or hook 93 that can engage with the sear as will be described presently. See FIGS. 6 and 7.

Formed in the part that provides the trigger guard 24, is a slanting cylindrical bore 52 within which is a hammer spring 54. The hammer 41 has an abutment 56 on its lower side which engages a plunger within the bore 52 which is acted on by the spring 54 and which drives the hammer in firing direction when it is released.

The trigger 26 has an upwardly extending part as designated at 60 which is pivotally attached to the disconnector member, that is, the member that releases the sear as designated at 62 and as will be referred to again presently.

At the forward part of the trigger is a bore 64 within which is a coil spring 66 which engages against the disconnector member 62. The pivotal connection between the trigger and the disconnector is designated by the numeral 70. The disconnector is in the form of a bell crank lever having a forwardly extending disconnector part 72 and having another portion 74 that extends downwardly from pivot 72 and rearwardly, the rearward part 76 having a flat upper surface as designated at 77.

The trigger and disconnector 62 are also joined by way of a pin and slot connection including a slot 80 in the disconnector 62 and the pin 82 extending from the trigger 26.

Numeral 84 designates a safety button and 86 designates a screw or fastener forming part of the trigger assembly.

The sear is designated by the numeral 90. See FIGS. 2, 4, 5, 6, and 7. It is mounted on a pivot pin 92. It has a square shoulder as designated at 94. Numeral 95 designates a cylindrical bore formed in the part that forms the trigger guard and in this bore is a spring 96 acting on the shoulder 94 of the sear normally urging the sear in a clockwise direction, that is, holding direction with respect to the hammer 41. The upper part of the sear 90 is rounded and at the backside of the upper part of the sear is formed a shoulder or a hook 91 that is engageable with the hook 93 on the hammer 41.

The forward end part 72 of the disconnector 62 is narrowed as shown forming a square shoulder as shown at 73 which can engage with the rear face of the sear 90 so as to rotate the sear 90 in a counter-clockwise direction for releasing the hammer 41. See FIGS. 6 and 7.

The sear 90 has a horizontal ledge 89 near its upper part just below the shoulder or hook 91 see FIG. 7. As will be described presently, the disconnector 62 can be moved angularly so that its end shoulder instead of engaging the sear 90 to rotate it will simply ride past the sear above the ledge 89.

The carrier extension 30 is positioned above the trigger mechanism as shown. It is actuated by the bolt carrier. In one form of this carrier extension it is bifurcated providing an elongated slot as shown at 97 in FIG. 7 so that the hammer when released can pass through the slot and be guided thereby.

The carrier extension member 30 is positioned over the trigger assembly as shown. It is pivoted at its forward end as shown at 100. Numeral 102 designates a recoil plunger which acts against a spring. It has piston 104 at its end operating in cylinder 106. The end part 110 of the carrier extension extends through the end of the cylinder 106 and bears against the piston member 104. The recoil mechanism is described more fully hereinafter in connection with FIGS. 8 and 9. On the lower side of the member 30 is a notch as designated at 114. See FIGS. 2, 4, and 5.

Numeral 118 designates the safety link member which is pivoted on a pivot 120. It has a shape as shown in FIGS. 2 and 7 having an extending toe part 122 which can engage in the notch 114.

Figure 4:
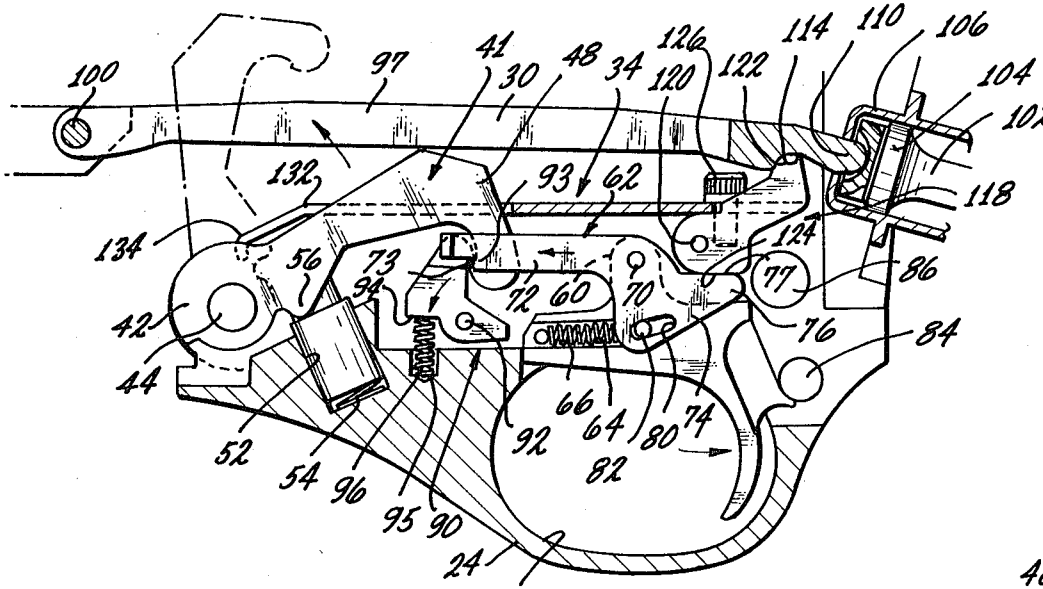
FIG. 4 is a further side elevational view of the trigger mechanism with the bolt in fully forward locked position ready for firing.

The safety link member 118 has a lower flat edge 124 which can be juxtaposed against the flat surface 77 of the disconnector member 62. See FIG. 7. As may be seen, and as will be described further, with parts as shown in FIG. 2, the trigger could be pulled to actuate the sear to release the hammer for firing. FIG. 4 illustrates the position of the parts for firing.

In FIG. 4 the part 62 is in engagement with the sear 90 for actuating it to release the hammer.

Figure 5:
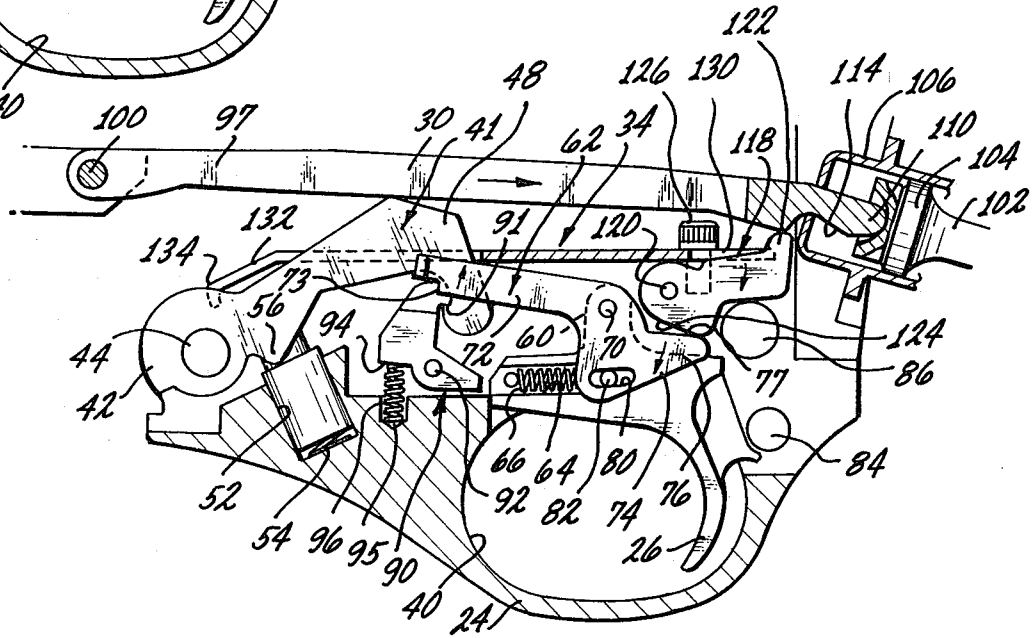
FIG. 5 is a view similar to that of FIGS. 3 and 4 but with the bolt not in the fully forward locked position.

FIG. 5 illustrates the parts in safety position. With the bolt carrier in any position except fully closed, the extension 30 is in a position such that the nose or toe 122 of the safety link 118 is moved out of the notch 114 and has moved in a clockwise direction so that the surfaces 77 and 124 engaging each other move the disconnector 62 in a clockwise direction so that it could not actuate the sear as will be described. The relationship of the extension 30 to the other operating parts of the gun is described more fully hereinafter.

The cover plate 34 is attached over the top of the trigger assembly by screws as shown at 126 and 127. It has an opening as shown at 130 to accommodate the safety link 118. It has cutouts at the sides as shown and an intermediate slot 132 to accommodate movement of the hammer 41. At the forward end as designated at 134, it is bent downwardly as may be seen in FIGS. 2, 4, and 5 to accommodate to the shape of the trigger unit.

Figure 8:
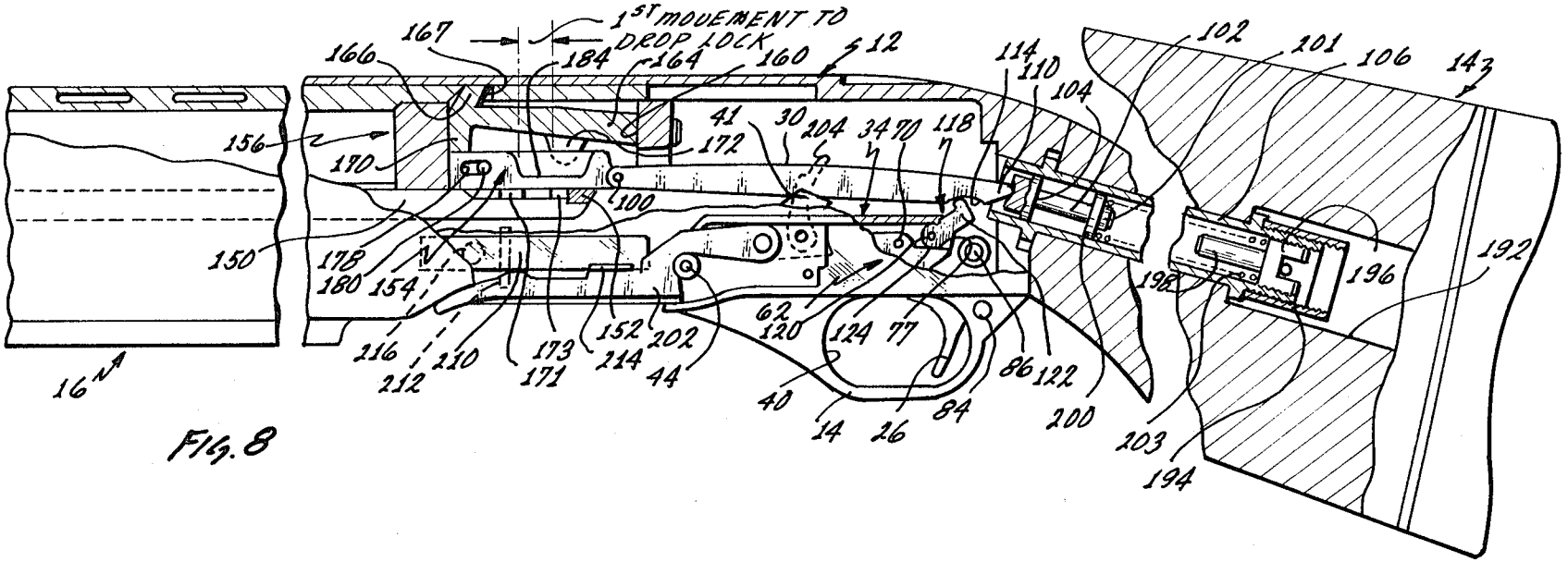
FIG. 8 is a side elevation of a gun partially broken away having the trigger mechanism fo the invention embodied in it in position for firing.
Figure 9:
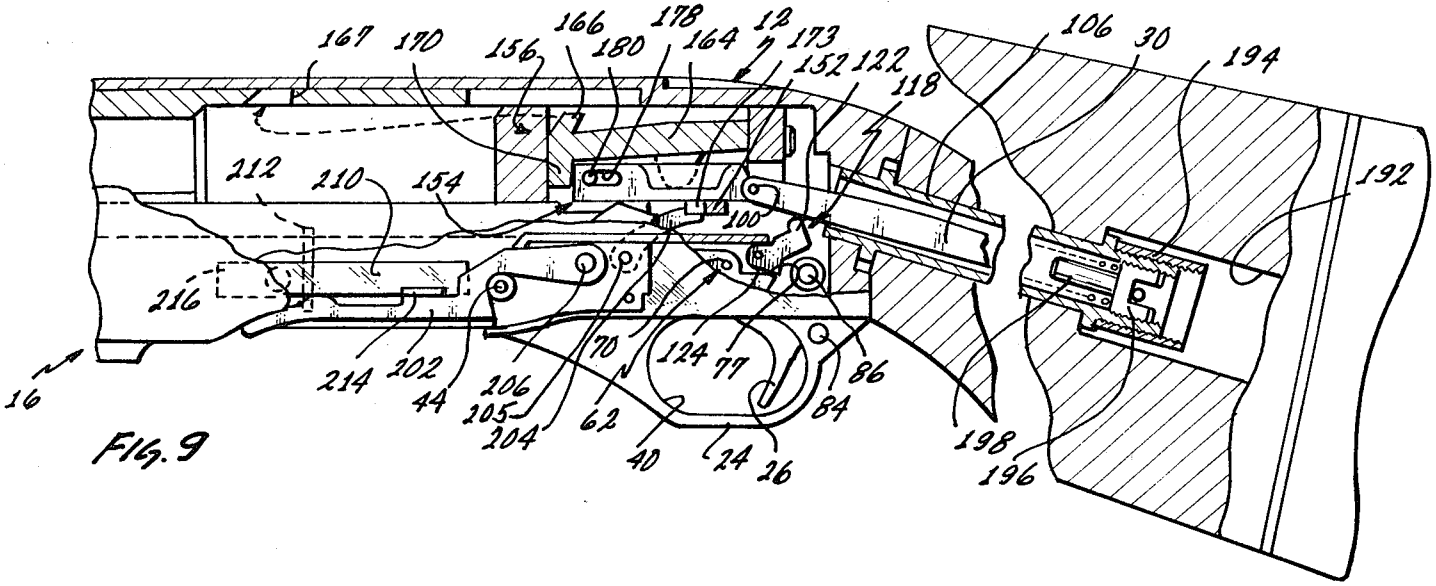
FIG. 9 is a view similar to that of FIG. 8 after the gun has been fired.

FIGS. 8 and 9 of the drawings are views partially broken away showing the trigger mechanism or assembly in position in the receiver 12 of the gun. The gun as shown, by way of example, is an automatic gas operated shotgun. In this type of automatic gun there is a gas piston operated by gases from the barrel of the gun that provides the automatic operation. FIGS. 8 and 9 illustrate the operation that as soon as the gas piston starts the rearward movement of the cylinder the trigger is disconnected from the sear and remains so disconnected until the parts are back into position as shown in FIG. 8. FIG. 9 shows the parts in position wherein the trigger is disconnected from the sear as described in the foregoing. The disconnect takes place before the bolt locking member 164 unlocks the bolt 156.

In FIG. 8 numeral 150 illustrates one of a pair of straps that are attached to the cylinder described above which are driven rearwardly by the gas piston. Numeral 152 designates a transverse member at the end of the straps which engages a bolt carrier 154. The bolt is designated by the numeral 156. The bolt carrier 154 is attached to the carrier extension member 30 by the pivot member 100 as previously described.

The bolt 156 has a slot formed in it as designated at 160 which receives the bolt locking member 164. The firing pin, not shown, extends through the bolt 156. The locking member 164 has a locking hook 166 at its end which hooked over a shoulder 167 in the barrel in the position of the parts as shown in FIG. 8. The locking member 164 has a pair of downwardly extending extensions one of which is shown at 172 and it has another downwardly extending extension, as shown at 170. These extensions cooperate with the bolt carrier 154 as will be described.

The bolt carrier 154 fits within the opening within the bolt 156 and has a sliding relationship with the bolt. The bolt carrier 154 has lateral extensions on both sides as shown at 171 and 173 which have sliding relationship with the bottom of the bolt 156. The bolt carrier 154 has a slot 178 in it. Numeral 180 designates a pin which engages in the slot 178. There is a limited sliding relationship between the bolt carrier 154 and the bolt 156. The bolt carrier 154 has a pair of similar depressions or cutouts in its sides, one of which is designated at 184 which cooperates with the extensions 172 on the locking member 164.

From the foregoing it is to be seen that as soon as the straps 150, start to move rearwardly the bolt carrier 154 moves rearwardly in an amount which is sufficient to move the carrier extension member 30 from the position of FIG. 8 to a position wherein the nose 122 of the safety link 118 is moved out of the notch 114 so that the trigger is disconnected from the sear. After that movement, the bolt carrier 154 is moved far enough to allow the extension 170 on the lock member 164 to drop downwardly releasing the hook part 166 from the shoulder 167 so as to allow the bolt to move rearwardly upon further movement of straps 150. After the movements just described have taken place the bolt moves from the position of FIG. 8 to the position of FIG. 9. It is to be noted that throughout this movement the nose 122 of the safety link 118 is in engagement with the lower edge of the carrier extension member 30 so that the trigger is positively held disconnected whenever the parts are out of the position of FIG. 8.

As can be observed from FIGS. 1, 8, and 9 the stock of the gun is at an angle with respect to the receiver and the barrel of the gun, as shown. The cylinder 106 is in a bore in the stock of the gun at the end of which is a counter bore 192 having in it an internally threaded fitting 194 which is threaded onto the end of the cylinder 106 as shown. This end of the cylinder is internally threaded as shown and it receives a screw threaded member 196 having an extending stem 198. The plunger 102 has a piston or a cylinder member 200 at its end having an extending part 201 and numeral 203 designates a coil spring between the parts 201 and 198 so that the plunger is normally biased in a leftward direction.

Numeral 202 designates the cartridge lifter which lifts the cartridge into the chamber. Numeral 204 designates a lifter dog pivoted to the lifter 202 by way of pivot 205. Pivot 205 extends through an extending arm or part of the lifter 202 (not shown). It has a square cutout at the end which latches against the part 173 of the bolt carrier as may be seen in FIG. 9. It is biased in a counter-clockwise direction by a spring not shown. Lifter 202 is pivoted around the pivot member 206 in the trigger frame. The lifter dog 204 is pivoted to an extending part (not shown) of the lifter 202 which is pivoted on a pivot member 206 extending through the trigger frame. The part of the lifter 202 (not shown) is on the opposite side of the trigger frame.

Numeral 210 designates a spring member carried by a stem 212 and having a lateral end tab 214 which extends over a part of the lifter 202. The member 210 is operable by way of a button 216 which is on the outside of the receiver whereby the lifter 202 and the action can be manually released so that the parts go back into the position of FIG. 8. The button 216 can move member 210 so that its end part releases the lifter 202 allowing the lifter 202 to move as described below when the bolt moves forward.

When the bolt moves to the rearward position of FIG. 9 the spring in the stock acting on the plunger immediately pushes it forward. This causes the lifter dog 204 to rotate in counter clockwise direction and this in turn causes the lifter 202 to move in a direction to move the cartridge up into a position ahead of the bolt and the bolt thrusts the cartridge into the chamber in the barrel.

OPERATION

Figure 6:
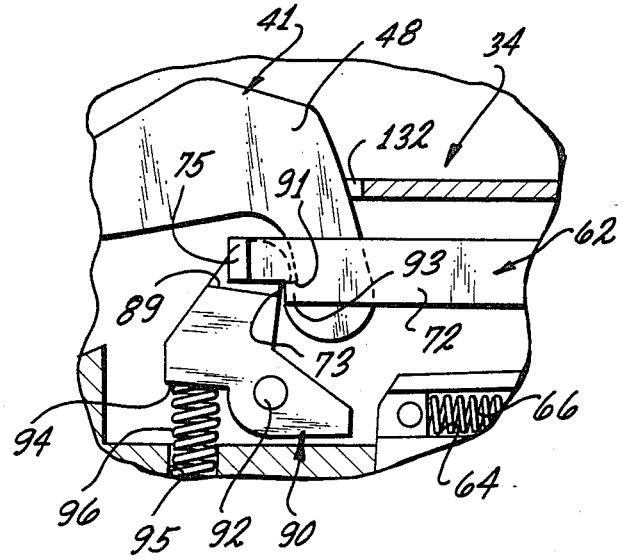
FIG. 6 is an enlarged partial view showing the relationship between the sear, hammer, and disconnector.
Figure 7:
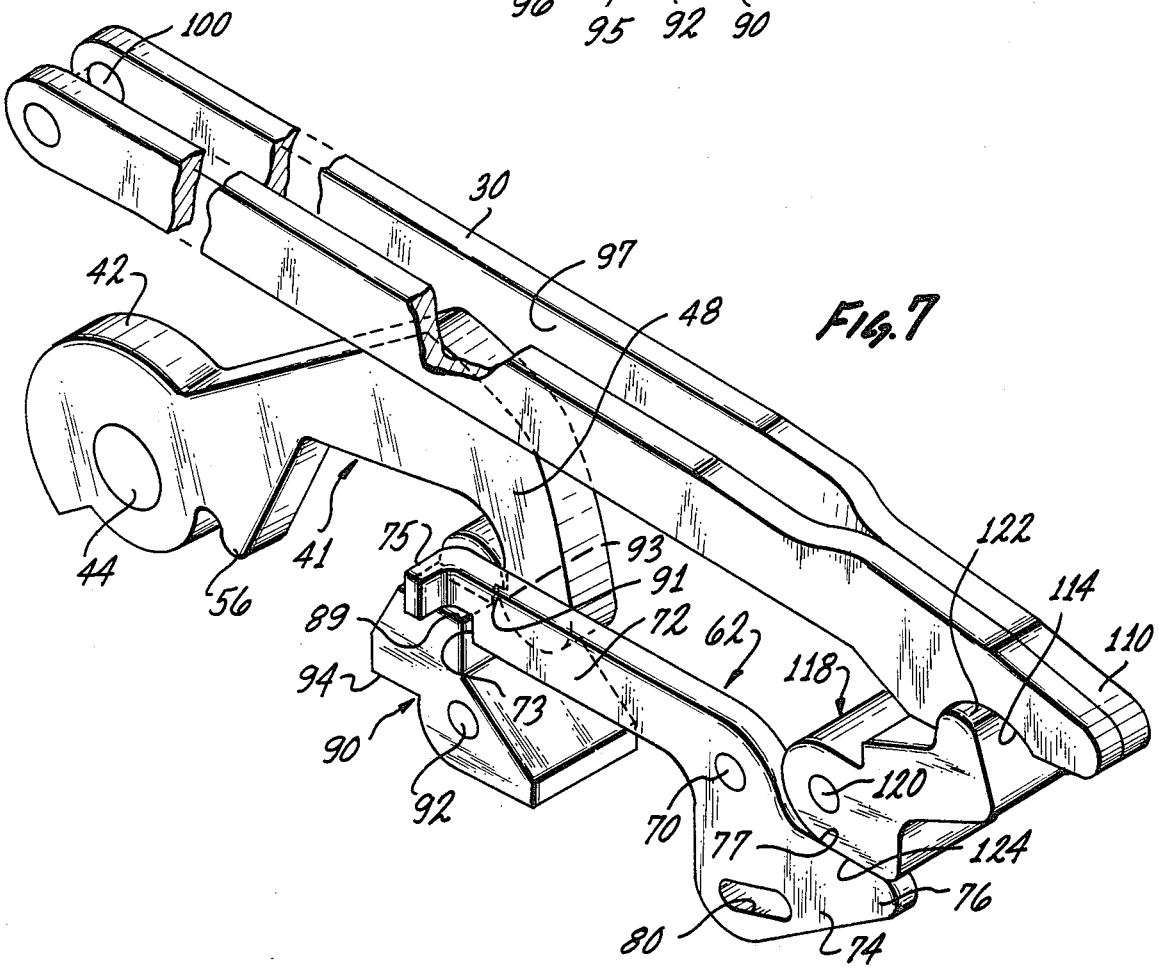
FIG. 7 is an enlarged isometric view showing the relationship of the parts of the mechanism.

Referring to FIGS. 2, 6, and 7 of the drawings, if the trigger is pulled rotating it counter-clockwise around the pivot 82, the arm 72 of disconnector 62 will be moved to the left so that the shoulder 73 on it will engage with the sear 90 rotating it in a counter-clockwise direction against the spring 95 so that it will release from the shoulder or hook 93 on the hammer 41 causing the gun to fire, that is, the hammer will be urged in a counter-clockwise direction by the spring 54 to engage the firing pin, the hammer moving through the slot 132 in the cover plate 34 and the slot in the carrier extension 30.

FIG. 4 illustrates the firing operation indicating the direction of movement of the trigger and of the arm 72 of the disconnector 62 and showing the hammer in outline in the fired position.

FIG. 5 illustrates the safety position. As shown, whenever the carrier extension is not in a fully closed position of the bolt, the nose 122 of the safety link 118 is out of the notch 114 in the carrier extension 30 so that the safety link member 118 is rotated in a clockwise direction around its pivot 120. Its surface 124 engages the surface 177 on the disconnector 62 and rotates the disconnector 62 about the pivot 70 against the force of spring 64, this movement being allowed by the pin and slot connections 80 and 82 between the disconnector 62 and the trigger 26. In this position of the parts, if the trigger is pulled the arm 72 of the disconnector 62 would move forwardly with the end of this arm moving past the sear 90 without actuating it but moving over the ledge 93.

FIGS. 8 and 9 illustrate the operative relationship between the trigger mechanism, the carrier extension member 30, the bolt carrier 154, and the bolt 156, the operation of these parts having been described in the foregoing. FIG. 8 shows the carrier extension 30 and link member 118 in the unlatched, that is, the safety position of the trigger in which position the gun can be fired. FIG. 9 shows the bolt in retracted position showing that the nose 122 of the safety link member 118 is in contact with the carrier extension member 30 at all times when the nose 122 of the safety link 118 is out of the notch 114. As indicated in the foregoing the type of gun shown is an automatic gas operated shotgun. In the position of FIG. 9 the lifter dog 204 is in latching position against the part 173 of the bolt carrier. In this position the bolt can be manually unlatched by manual operation of the buttom 216 to release the lifter 202 and the dog 204. In automatic operation the lifter dog rotates counter clockwise and drives the lifter 202 clockwise. The tail end of the lifter dog releases engagement of the dog 204 from the part 173 of the bolt carrier.

As described in the foregoing when the gun is fired the straps 150 attached to the bolt carrier first move the bolt carrier approximately three hundred thousands (0.300) of an inch, causing the nose 122 of the safety link 118 to move out of the notch 114 disconnecting the trigger from the sear. The locking member 164 then moves downwardly unlocking the bolt allowing it to move back into position of FIG. 9.

From the foregoing, those skilled in the art will readily understand and appreciate the nature of the invention and the manner in which it achieves all of the objects as set forth in the foregoing. As may be observed, the trigger can only operate to fire the gun when the safety link element 118 is positioned for firing. As may be seen, the bolt has to be in fully closed and locked position in order for the link to be in the position as shown in FIGS. 2 and 8 wherein the disconnector 62 can act on the sear to fire the gun.

The foregoing disclosure is representative of a preferred form of the invention and is to be interpreted in an illustrative rather than a limiting sense.

I claim:

1. A gun mechanism for a gun having a hammer engageable with a firing pin, a sear engageable with the hammer adapted for releasing the hammer for firing, a trigger member, a disconnector member having connections with the trigger member and having a part engageable with the sear for disengaging it from the hammer for firing, the gun mechanism having a bolt and a bolt carrier including an extending member extending from the bolt carrier having proximity to the trigger and having a position wherein the bolt is in fully closed position, and means including a link member providing engagement between said extending member and the disconnector member, the bolt carrier and extending member being constructed whereby in any position other than the closed and locked position of the bolt and before movement of the bolt, the said link member engages said extending member and positively acts on the said disconnector member whereby to positively hold it in a position to prevent it from bringing about disengagement between the sear and the hammer.

2. A mechanism as in claim 1 wherein the said disconnector member has a pivotal connection to the trigger member and means providing for limited relative movement as between the disconnector member and trigger member about said pivotal connection.

3. A mechanism as in claim 2 including a spring carried by the said trigger member and positioned to exert a biasing force on the said disconnector member, the said means providing for limited movement as between the disconnector member and the trigger member providing for relative movement of the disconnector member against the bias of said spring by the action of said link member.

4. A mechanism as in claim 3 including pin and slot connections as between the disconnector member and the trigger member for providing for the said limited movement.

5. A mechanism as in claim 3 wherein said spring member carried by the trigger member is positioned to urge the said disconnector member in a direction in which the disconnector member engages the said sear member.

6. In a gun having a bolt, a bolt locking member and a bolt carrier having cooperative relationship with the bolt, a hammer engageable with a firing pin, a sear engageable with the hammer adapted for releasing the hammer for firing, a trigger member, the improvements comprising the bolt carrier having connections to the bolt providing for limited relative movement of the bolt carrier with respect to the bolt, the bolt carrier including an extending member extending from the bolt carrier, a disconnector member having connections with the trigger member and having part engageable with the sear for disengaging it from the hammer, means including a link member providing engagement between the said extending member and the disconnector member, the said extending member and disconnector member having a construction whereby upon initial movement of the bolt carrier before the bolt is moved and unlocked the said link member positively acts on said disconnector member whereby to hold it in position to prevent engagement between the sear and the disconnector member.

7. A gun as in claim 6 wherein the said bolt carrier and bolt locking member have an interrelationship whereby after a predetermined initial movement of the bolt carrier it causes the locking bolt to release.

8. A mechanism as in claim 1 wherein connection is provided between the bolt and the bolt carrier allowing relative movement of the bolt carrier with respect to the bolt.

* * * * *